US007029301B2

(12) United States Patent
Ootori et al.

(10) Patent No.: US 7,029,301 B2
(45) Date of Patent: Apr. 18, 2006

(54) CONNECTION DEVICE, CONNECTOR UNIT, CONNECTORS, AND ELECTRONIC EQUIPMENT

(75) Inventors: Yasuhiro Ootori, Tokyo (JP); Kenichi Nagase, Chiba (JP); Mitsuyuki Tokusashi, Tokyo (JP); Tomonori Hasegawa, Tokyo (JP); Hironori Yagi, Tokyo (JP)

(73) Assignee: Sony Computer Entertainment Inc., Tokyo (JP)

( * ) Notice: Subject to any disclaimer, the term of this patent is extended or adjusted under 35 U.S.C. 154(b) by 0 days.

(21) Appl. No.: 10/990,337

(22) Filed: Nov. 16, 2004

(65) Prior Publication Data

US 2005/0148224 A1 Jul. 7, 2005

Related U.S. Application Data

(63) Continuation of application No. PCT/JP03/03429, filed on Mar. 20, 2003.

(51) Int. Cl.
*H01R 13/74* (2006.01)

(52) U.S. Cl. ..... 439/248

(58) Field of Classification Search ..... 439/551, 439/247, 248, 545, 546, 570, 573; 248/27.1, 248/27.3; 70/370
See application file for complete search history.

(56) References Cited

U.S. PATENT DOCUMENTS 4,312,558 A * 1/1982 Duerr et al. ..... 439/551
4,820,180 A 4/1989 Mosquera et al.
5,118,236 A * 6/1992 Rodriguez et al. ..... 411/378
6,238,242 B1 * 5/2001 Hwang ..... 439/545

FOREIGN PATENT DOCUMENTS

| | | |
|---|---|---|
| JP | 62-127686 | 8/1987 |
| JP | 2-24983 | 1/1990 |
| JP | 02-143790 | 12/1990 |
| JP | 04-85587 | 7/1992 |
| JP | 2000-09001 | 3/2000 |
| JP | 2001-313118 | 11/2001 |

OTHER PUBLICATIONS

International Preliminary Examination Report dated Mar. 11, 2004.
International Search Report dated Jul. 8, 2003.

* cited by examiner

*Primary Examiner*—Alexander Gilman
(74) *Attorney, Agent, or Firm*—Katten Muchin Rosenman LLP

(57) ABSTRACT

A socket (333) of a connector (33) of an adapter (2) has a projecting portion (loose-fit portion) (333B) inserted into a hole (353A) of a base member (35) to support the connector (33) in loosely fitted manner. A diameter (L3) of the projecting portion (333B) is smaller than a diameter L4 of a hole (353A) of the base member (35). A length (L5) along an insertion direction into the hole (353A) is greater than a thickness of the connector attachment side (353).

The connector (32) of the adapter (2) has an insertion portion (323) inserted into a cutout portion (353B) of the base member (35). A length (L8) of an extending direction of an insertion body (323A) of the insertion portion (323) is greater than the thickness (L9) of the connector attachment side, while its width (L6) is smaller than a width (L7) of the cutout portion (353B).

7 Claims, 12 Drawing Sheets

CONNECTION DEVICE, CONNECTOR UNIT, CONNECTORS, AND ELECTRONIC EQUIPMENT

CROSS-REFERENCE TO RELATED APPLICATION

The present application is a continuation of International Application No. PCT/JP03/03429 which was filed on Mar. 20, 2003, which is herein incorporated by reference.

TECHNICAL FIELD

The present invention relates to a connecting device, a connector unit, a connector, and an electronic equipment.

BACKGROUND ART

Conventionally, an entertainment device having a first electronic equipment as an entertainment device body, a second electronic instrument connected to the first electronic equipment, and, HDD (Hard Disk Drive) etc., for example, for enhancing storage capacity of the first electronic equipment has been used. In many cases, the hard disk and the first electronic instrument are connected through an adapter (connecting device).

The adapter is provided with a plurality of connectors such as a power source connector, an IDE (Integrated Device Electronics) connector, a connector connected to the first electronic equipment, and the like. When these connectors are completely fixed, connection of the adapter and the hard disk and connection of the adapter and the first electronic equipment possibly become difficult due to transition of the attachment position.

To avoid such problem, the conventional adapter has adopted a connector unit 8 as shown in FIG. 12. The connector unit 8 is arranged so that a substrate 81 with a connector 80 mounted thereon is fixed on a movable plate 82 having a substantially Z-shape in a cross section by a fixing screw 83 and a base member 84 is inserted into a space formed between the substrate 81 and the movable plate 82. The base member 84, the substrate 81, and the movable plate 82 are fixed by a screw 85 with shoulder, and the substrate 81 and the movable plate 82 respectively have holes with approximately same diameters as shoulder portion 851 of the screw 85. On the other hand, the base member 84 has a hole 841 with a greater diameter than the shoulder portion 851 of the screw 85. Since a gap is formed between the shoulder portion 851 of the screw 85 and the hole 841, the movable plate 82 and the substrate 81 can be slid to the base member 84, which makes it possible to adjust a position of the connector 80 mounted on the substrate 81.

However, such a conventional adapter has a problem in which it requires many components like the base member 84 and the movable plate 82, as well as its complicated structure.

An object of the present invention is to provide a connecting device, a connector unit, a connector, and an electronic equipment with reduced number of components and simple structure.

DISCLOSURE OF THE INVENTION

A connecting device of the present invention may employ configurations (1) or (2) as described below.

(1) According to an aspect of the present invention, a connecting device connecting an electronic equipment and another electronic equipment connected thereto through a plurality of connectors, the connecting device includes: a base member to which at least any one of the connectors is attached; and an engaging member which is attached to a socket formed on the connector to be attached to the base member and engages with the base member, in which at least one of the socket and the engaging member is provided with a loose-fit portion that is inserted into a hole of the base member and has a diameter smaller than the hole and a length along the insertion direction into the hole greater than the thickness of the base member, the loose-fit portion supporting the connector to the base member in loosely fitted manner when the engaging member is attached to the socket.

With this configuration of the present invention, at least one of the socket or the engaging member of the connector attached to the base member is provided with a loose-fit portion that is inserted into the hole of the base member and has the diameter smaller than the diameter of the hole and the length along the insertion direction greater than the thickness of the base member, and thus the attachment position of the connector can be arbitrarily adjusted to the base member.

Since the length of the loose-fit portion in the insertion direction into the hole is greater than the thickness of the base member, a clearance is formed between the connector and the base member to avoid close contact of them. Therefore, the attachment position of the connector can be easily adjusted to the base member.

Further, the connecting device of the present invention employs a structure in which the connector is directly attached to the base member. Thus, the number of the components can be reduced and the structure can be simplified compared with the conventional connecting device in which the connector is attached to a substrate fixed to a movable plate and the base member is disposed between the movable plate and the substrate to adjust the attachment position of the connector by moving the movable plate to the base member.

It is preferable that the engaging member has a screw shaft attached to and screwed into the socket, and that the loose-fit portion is provided on a base end of the insertion direction of the screw shaft and has a diameter greater than the screw shaft.

In the present invention, a socket, e.g. a screw hole for the engaging member screwed into only requires to be added to the connector having been conventionally used, so that the connector does not have to be molded into a special shape. Therefore, the cost increase can be avoided.

The engaging member may be attached to the socket by screwing, and the loose-fit portion may be provided on the connector and be inserted into the hole of the base member to be a projecting portion projecting from the hole.

In the present invention, the connector is attached by inserting the projecting portion (loose-fit portion) provided to the connector into the hole of the base member. Therefore, the attachment position of the connector can be easily determined to the base member.

(2) According to another aspect of the present invention, a connecting device connecting an electronic equipment and another electronic equipment connected thereto through a plurality of connectors, the connecting device includes a base member to which at least any one of the connectors is attached, the base member has a connector attachment side to which the connector is attached, in which the attachment side being provided with a cutout portion being cut from an end of the connector attachment side toward the inside thereof; the connector attached to the base member has a housing body located on a front side of the connector attachment side of the base member, and an insertion portion provided to the housing body and inserted into the cutout portion from the end of the connector attachment side; the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member; and a width of the insertion body orthogonal to the extending direction is smaller than a width of the cutout portion orthogonal to the cutout direction, and a length of the insertion body in the extending direction is greater than a thickness of the connector attachment side of the base member.

In the present invention, the insertion portion of the connector is inserted into the cutout portion from the end of the cutout portion of the base member. The width of the insertion body extending to penetrate the cutout portion of the connector attachment side in a direction orthogonal to the extending direction (width along the direction orthogonal to the cutout direction of the cutout portion) is smaller than the width of the cutout portion in the direction orthogonal to the cutout direction of the cutout portion Thus, the connector can be moved along the cutout direction of the cutout portion and along the direction orthogonal to the cutout direction, so that the attachment position of the connector can be adjusted to the base member.

The length of the insertion body penetrating the cutout portion of the connector attachment side in the extending direction is greater than the thickness of the connector attachment side, so that clearances are formed between the engaging portion of the connector and the back side of the connector attachment side, and between the housing body and the connector attachment side. Since the connector and the connector attachment side of the base member do not contact closely, the attachment position of the connector can be adjusted easily.

Further, the connecting device of the present invention employs a structure in which the connector is directly attached to the base member. Thus, the number of the components can be reduced and the structure can be simplified compared with the conventional connecting device in which the connector is attached to a substrate fixed to a movable plate and the base member is disposed between the movable plate and the substrate to adjust the attachment position of the connector by moving the movable plate to the base member.

In the present invention, it is preferable that: the base member has a folded surface folded from the connector attachment side toward the out-of-plane direction thereof; the cutout portion is so arranged that a first end is cut from a ridge line of the connector attachment side and the folded surface toward the inside thereof and a second end reaches the folded surface, the cutout portion having a greater width in a part formed on the folded surface in orthogonal to the cutout direction than a width of the first end cut toward the inside of the connector attachment side; the insertion portion of the connector is inserted from the folded surface side of the cutout portion; and the connector has a detent abutting on the folded surface and preventing the attached connector from detaching from the base member.

In the present invention, the width of the cutout portion on the folded surface in orthogonal to the cutout direction is greater than the width of the first end cut on the connector attachment side. Therefore, the insertion portion of the connector can be easily inserted from the side of the folded surface. Since the connector has a detent abutting on the folded surface, the connector can be securely attached to the base member.

It is preferable that the insertion portion and the detent are integrally molded with the housing body.

The number of components can be reduced by molding the insertion portion and the detent integrally with the housing.

It is preferable that the plurality of connectors are disposed on a common side of the base member.

By attaching the plurality of connectors on a common side of the base member, the electronic equipment and another electronic equipment mutually connected through the connecting device of the present invention can be disposed on one side of the connecting device Further, in the present invention, it is preferable that an attachment position of at least one of the plurality of connectors is fixed.

By fixing the position of at least one connector, the connecting device, the electronic equipment, and another electronic equipment can be connected with the fixed connector as a positioning reference. With this configuration, the connecting device, the electronic equipment, and another electronic equipment can be connected smoothly.

A connector unit according to still another aspect of the present invention includes: a connector; a base member for the connector to be attached; and an engaging member attached to a socket formed on the connector to engage with the base member, in which at least one of the socket and the engaging member is provided with a loose-fit portion that is inserted into a hole of the base member and has a smaller diameter than the hole and a larger length along the insertion direction into the hole than the thickness of the base member, the loose-fit portion supporting the connector to the base member in loosely fitted manner when the engaging member is attached to the socket.

In the present invention, at least one of the socket or the engaging member of the connector is provided with a loose-fit portion that is inserted into the hole of the base member and has the diameter smaller than the diameter of the hole and length along the insertion direction greater than the thickness of the base member, and thus the attachment position of the connector can be arbitrarily adjusted to the base member.

Since the length of the loose-fit portion is greater than the thickness of the base member, a clearance is formed between the connector and the base member to avoid close contact of them. Therefore, the attachment position of the connector can be easily adjusted to the base member.

Further, the connector unit of the present invention employs a structure in which the connector is directly attached to the base member. Thus, the number of the components can be reduced and the structure can be simplified compared with the conventional connector unit in which the connector is attached to a substrate fixed to a movable plate and the base member is disposed between the movable plate and the substrate to adjust the attachment position of the connector by moving the movable plate to the base member.

A connector unit according to yet another aspect of the present invention includes: a connector; and a base member for the connector to be attached: the base member has a connector attachment side for the connector to be attached, in which the connector attachment side being provided with a cutout portion cut from an end toward the inside thereof; the connector has a housing body located on a front side of the connector attachment side when it is attached to the connector, and an insertion portion provided to the housing body and inserted into the cutout portion from the end of the connector attachment side; the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member; a width of the insertion body orthogonal to the extending direction is smaller than a width of the cutout portion orthogonal to the cutout direction; and a length of the extending direction of the insertion body is greater than a thickness of the connector attachment side of the base member.

In the present invention, the insertion portion of the connector is inserted into the cutout portion from the end of the cutout portion of the base member. The width of the insertion body extending to penetrate the cutout portion of the connector attachment side in a direction orthogonal to the extending direction (width along the direction orthogonal to the cutout direction of the cutout portion) is smaller than the width of the cutout portion in the direction orthogonal to the cutout direction of the cutout portion. Thus, the connector can be moved along the cutout direction of the cutout portion and along the direction orthogonal to the cutout direction, so that the attachment position of the connector can be adjusted to the base member.

The length of the insertion body penetrating the cutout portion of the connector attachment side in the extending direction is greater than the thickness of the connector attachment side, so that clearances are formed between the engaging portion of the connector and the back side of the connector attachment side, and between the housing body and the connector attachment side. Since the connector of the base member and the connector attachment side do not contact closely, the attachment position of the connector can be adjusted easily.

Further, the connector unit of the present invention employs a structure in which the connector is directly attached to the base member. Thus, the number of the components can be reduced and the structure can be simplified compared with the conventional connector unit in which the connector is attached to a substrate fixed to a movable plate and the base member is disposed between the movable plate and the substrate to adjust the attachment position of the connector by moving the movable plate to the base member.

A connector attached to a base member according to a further aspect of the present invention includes: a housing body located on a front side of the connector attachment side of the base member for the connector to be attached; and an insertion portion provided to the housing body and inserted into the cutout portion from the end of the connector attachment side, in which the insertion portion has an insertion body extending from the housing body in a direction orthogonal to the connector attachment side to penetrate the cutout portion and, an engaging portion disposed at a tip end of the extending direction of the insertion body to engage at the back side of the connector attachment side of the base member; and a width of the insertion body orthogonal to the extending direction is smaller than a width of the cutout portion orthogonal to the cutout direction, and a length of the insertion body in the extending direction is greater than a thickness of the connector attachment side.

In the present invention, the connector has the insertion portion inserted into the cutout portion from the end of the cutout portion of the base member, and the insertion body of the insertion portion extends in the direction orthogonal to the connector attachment side to penetrate the cutout portion. The width of the insertion body in orthogonal to the extending direction (width along the direction orthogonal to the cutout direction of the cutout portion) is smaller than the width of the cutout portion in the direction orthogonal to the cutout direction of the cutout portion. Thus, when such connector is attached to the base member, the connector can be moved along the cutout direction of the cutout portion and along the direction orthogonal to the cutout direction, so that the attachment position of the connector can be adjusted to the base member.

The length of the insertion body penetrating the cutout portion of the connector attachment side in the extending direction is greater than the thickness of the connector attachment side, so that clearances are formed between the engaging portion of the connector and the back side of the connector attachment side, and between the housing body and the connector attachment side. Since the connector and the connector attachment side of the base member do not contact closely, the attachment position of the connector can be adjusted easily.

The connector of the present invention is the one directly attached to the base member. Unlike the conventional connector, it does not require to attach the connector to the substrate, fix the substrate to the movable plate, and dispose the base member between the movable plate and the substrate. Therefore, by using the connector of the present invention, the number of the components can be reduced and the structure can be simplified.

An electronic equipment with the above described connector unit can be proposed as the electronic equipment of the present invention. In other words, an electronic equipment according to a still further aspect of the present invention includes: a connector; and a connector unit having a base member for the connector to be attached; in which the connector unit has an engaging member attached to a socket formed on the connector to engage with the base member; at least one of the socket and the engaging member is provided with a loose-fit portion that is inserted into a hole of the base member and has a diameter smaller than the hole and a length along the insertion direction into the hole greater than the thickness of the base member; and the loose-fit portion supports the connector to the base member in loosely fitted manner when the engaging member is attached to the socket.

An electronic equipment according to a yet further aspect of the present invention includes: a connector; and a connector unit having a base member for the connector to be attached, in which the base member of the connector unit has a connector attachment side to which the connector is attached, the connector attachment side being provided with a cutout portion being cut from an end toward the inside thereof; the connector has a housing body located on a front side of the connector attachment side when it is attached to the connector, and an insertion portion provided to the housing body and inserted into the cutout portion from the end of the connector attachment side; the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member; a width of the insertion body orthogonal to the extending direction is smaller than a width of the cutout portion orthogonal to the cutout direction; and a length of the extending direction of the insertion body is greater than a thickness of the connector attachment side of the base member.

Since electronic equipment of the present invention has the above-described connector unit, the attachment position of the connector can be easily adjusted, and reduction of the number of components and simplification of the structure can be achieved.

BEST MODE FOR CARRYING OUT THE INVENTION

An embodiment of the present invention will be described below with reference to the attached drawings.

Figure 1:
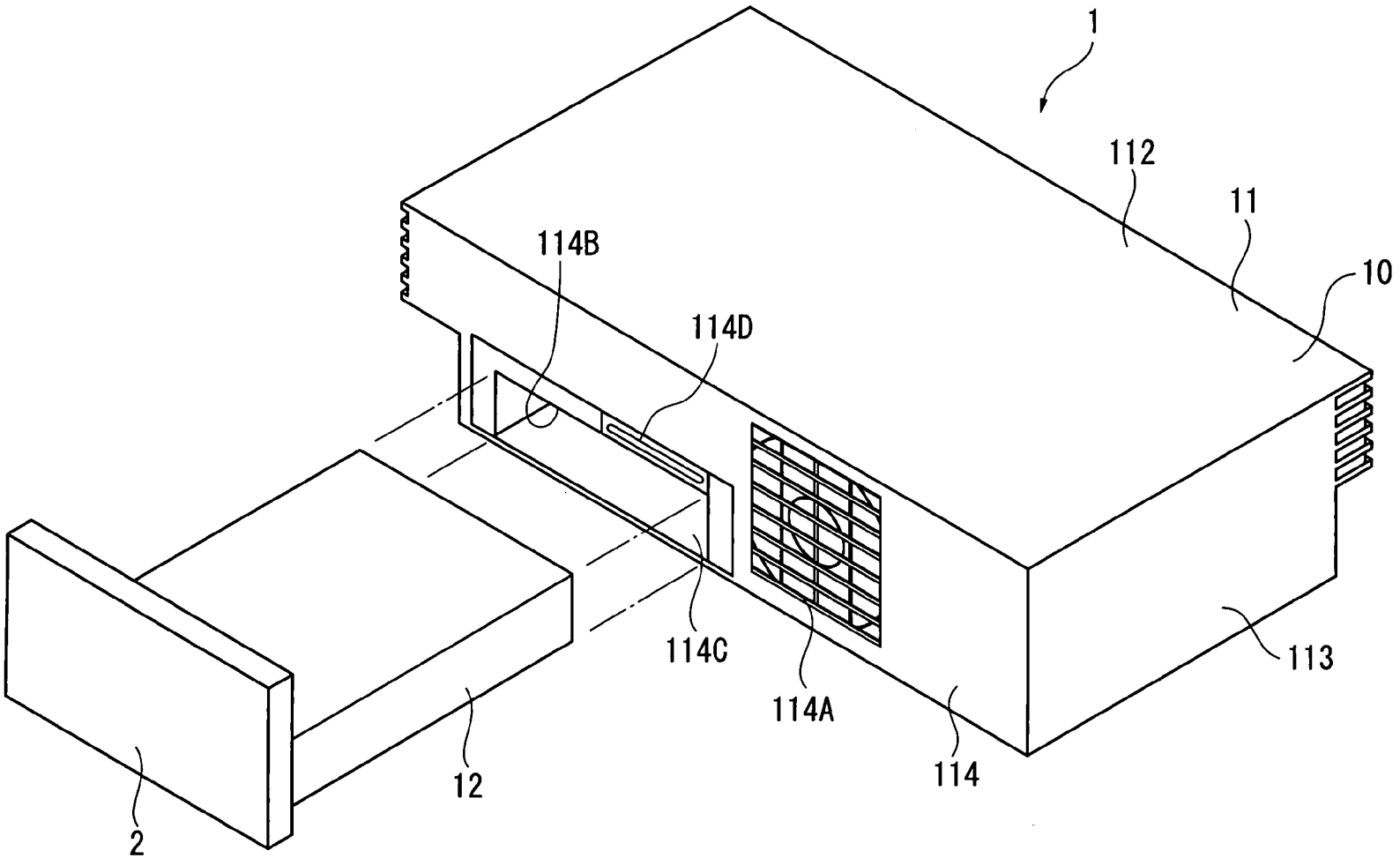
FIG. 1 is a perspective view showing an entertainment device according to an embodiment of the present invention.

FIG. 1 shows an entertainment device 1 as an electronic equipment. The entertainment device 1 has functions for reading out a game program recoded in an optical disc etc. to execute the game according to a direction of a user and reproducing image, music, and the like recorded in an optical disc. The entertainment device 1 has a first electronic equipment 10 including a disc device, CPU (Central Processing Unit), a controller slot, a memory slot, and a master electrical switch etc., which are not shown; a HDD 12 as a second electronic equipment (another electronic equipment); and an adapter (connecting device) 2 mutually connecting the HDD 12 and the first electronic equipment 10.

The first electronic equipment 10 has a casing 11. The casing 11 is formed to be a rectangular shape in plan view and a substantially L-shape in a cross section, and is provided with a bottom surface (not shown), an upper side 112 opposing the bottom surface, a pair of lateral sides 113, a front surface (not shown), and a rear side 114 disposed between edges of the bottom surface and the upper side 112.

Although not shown, the rear side 114 is provided with an image/audio output terminal for outputting various signals such as an image signal and an audio signal etc. to a display device like a Television, a communication terminal for communicating with an external device, an AC inlet as a power supply terminal for supplying electric power to the first electronic device 10 from an external power source, a master electrical switch for controlling the power supply from the outside power source, and the like.

The rear side 114 is also provided with an exhaust port 114A, the inner side of which an exhaust fan 115 is disposed.

In addition, an insertion slot 114B for inserting the HDD 12 is formed adjoining the exhaust port 114A on the rear side 114.

Inside of the insertion slot 114B, a metallic casing 114C opening toward the insertion slot 114B, and the HDD 12 is stored in the casing 114C. At the upper side of the insertion slot 114B (near the upper side 112), a female connector 114D connected to a male connector 34 (described later) is attached.

The HDD 12 stores progress status of the game executed by the first electronic equipment 10, and records and stores games etc. downloaded from a server when the first electronic equipment 10 is connected to the internet. Although not shown, an IDE (Integrated Device Electronics) female connector and a power female connector are provided on a rear side at a rear end side in an insertion direction of the HDD 12 into the insertion slot 114B.

Here, both the IDE female connector and the power female connector are 40-pin types. These connectors are connected to connectors 32 and 33 (described later) provided to the adapter 2. Connecting the HDD 12 to the first electronic equipment 10 through the adapter 2 allows for power supply from the first electronic equipment 10 and data transfer between the HDD 12 and the first electronic equipment 10.

Figure 2:
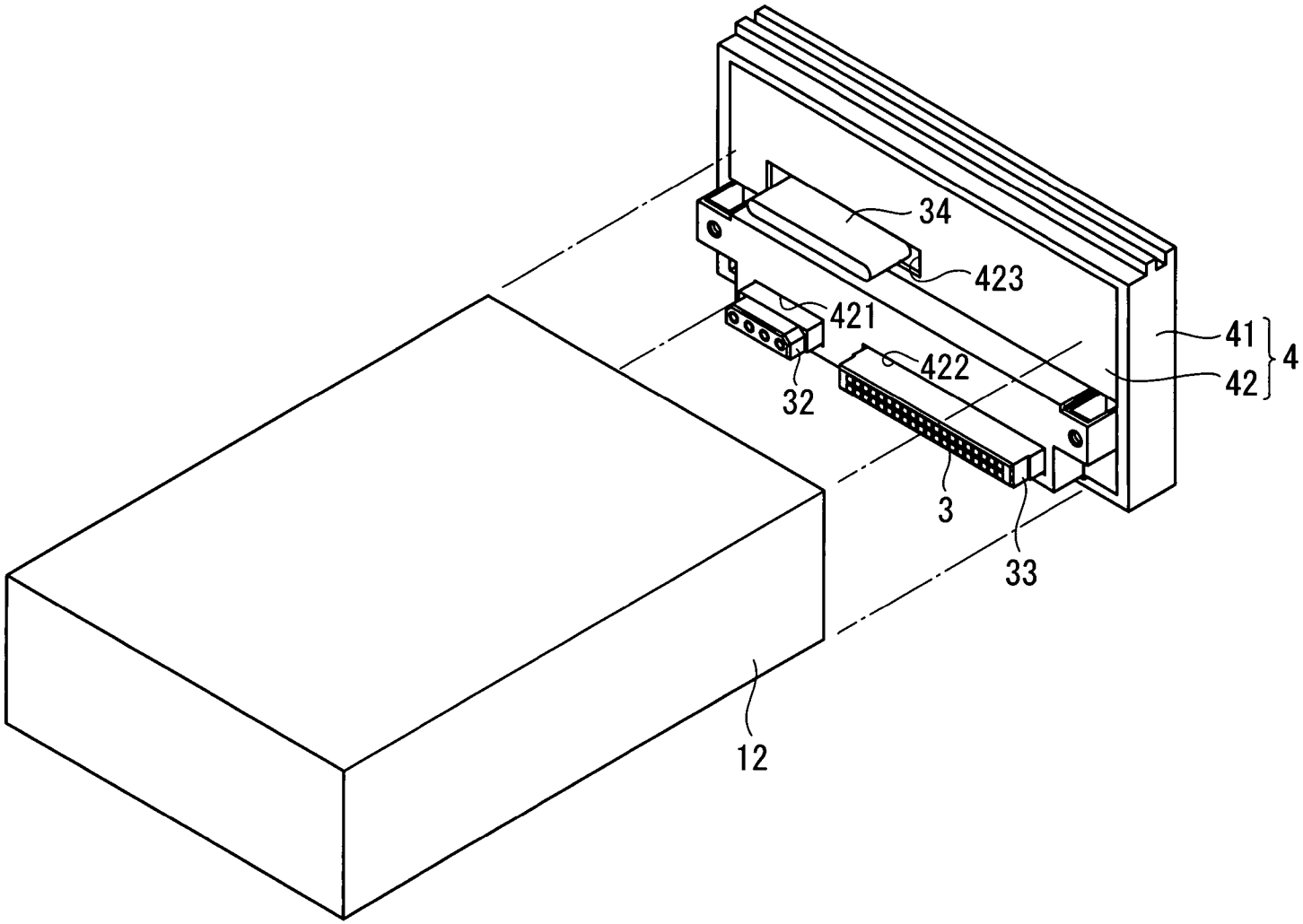
FIG. 2 is a perspective view showing a connecting device and a HDD.
Figure 3:
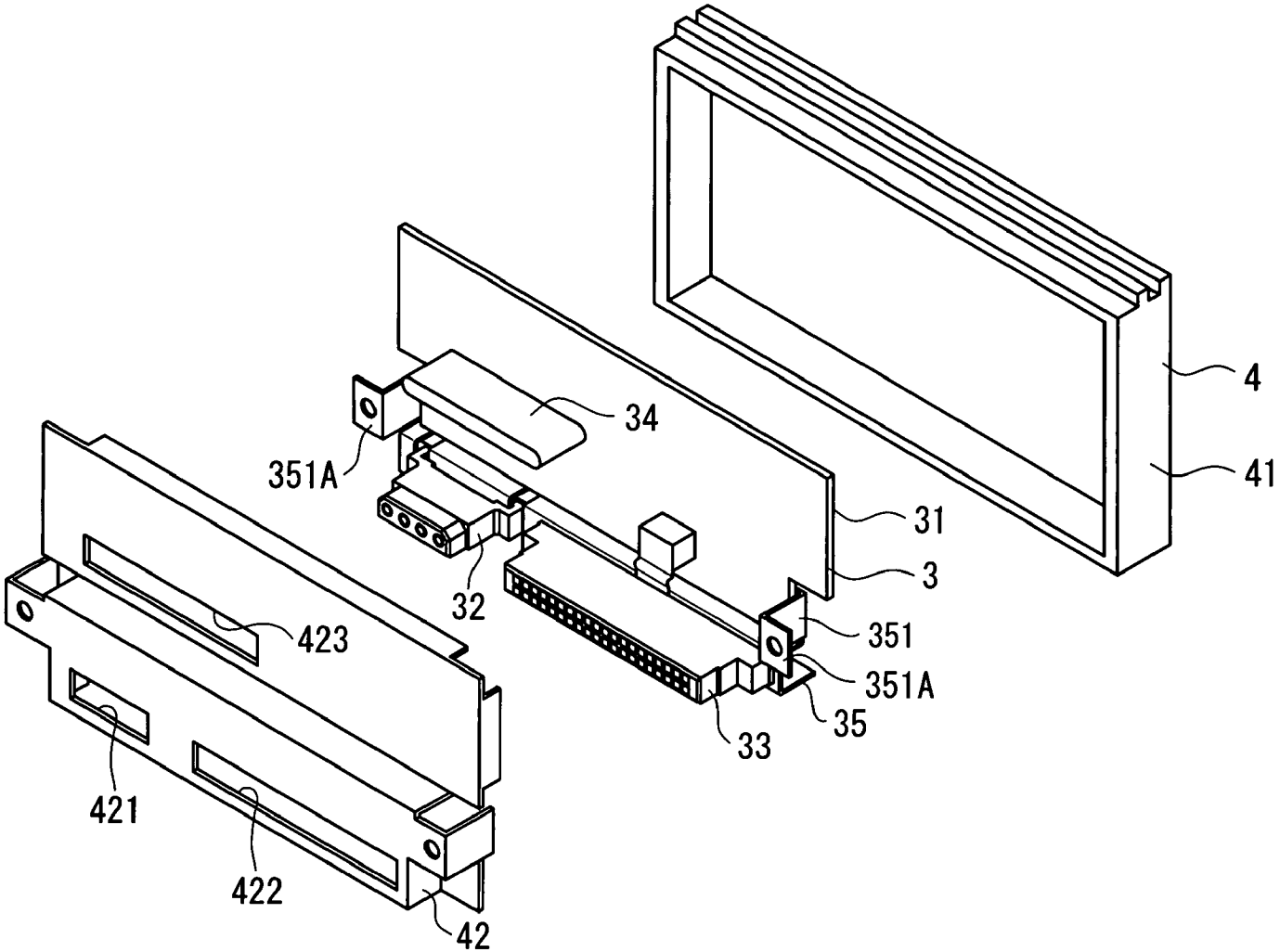
FIG. 3 is an exploded perspective view showing the connecting device.

As shown in FIGS. 2 and 3, the adapter 2 has an adapter body (connector unit) 3 and a case 4 storing the adapter body 3 therein.

The case 4 has a case body 41 with an opening for the adapter body 3 to be stored and a lid member 42 attached to the opening of the case body 41.

The case body 41 has a rear side having a rectangular shape in plan view arranged opposite to the opening and upright sides arranged vertically at an edge of the rear side.

The lid member 42 is made of a metal such as aluminum and has a surface covering the opening of the case body 41. Openings 421 to 423 are provided on the front side to expose a male power connector 32 of the adapter body 3, an IDE male connector 33, and the male connector 34. The opening 421 for exposing the male power connector 32 and the opening 422 for exposing the IDE male connector 33 are arranged adjacent to each other in the longitudinal direction, and the opening 423 for exposing the male connector 34 is provided above the opening 421 for the male power connector 32 in the figure.

Figure 4:
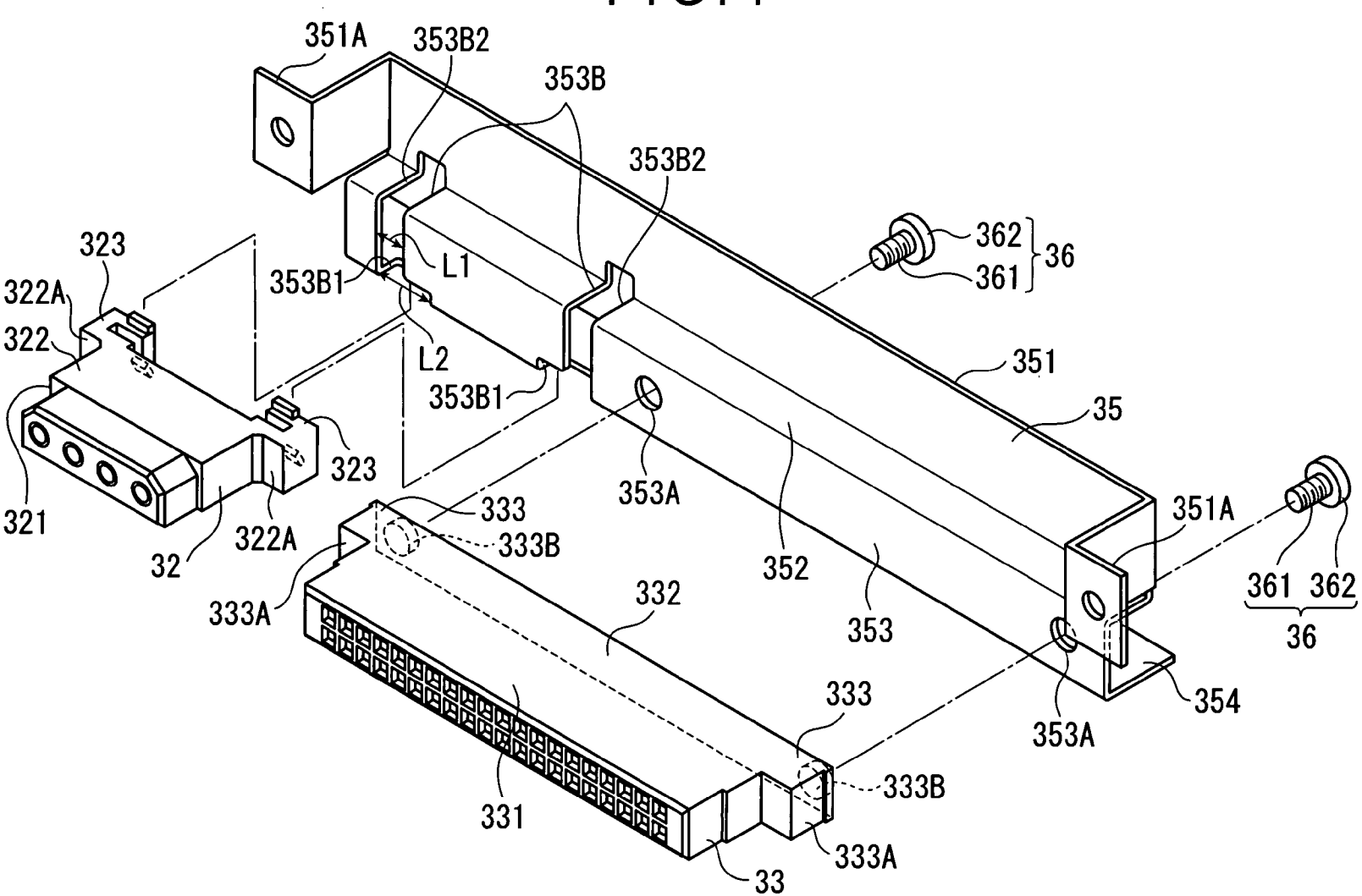
FIG. 4 is an exploded perspective view showing a primary portion of the connecting device.

The adapter body 3, as shown in FIG. 3 and FIG. 4, has a substrate 31, the above-described three connectors 32 to 34, a base member 35 allowing the male power connector 32 and the IDE male connector 33 to be attached thereto among the three connectors, and an engaging member 36.

The male connector 34 is mounted on the substrate 31 as well as a circuit for supplying electric power to the HDD 12 from the first electronic equipment 10 and a circuit for transferring data between the first electronic equipment 10 and the HDD 12.

In this arrangement, an attachment position of the male connector 34 is fixed on the substrate 31. A portion of the male connector 34 exposed from the opening 423 of the lid member 42 allows a user to check by looking from above the adapter 2 in connecting the adapter 2 to the electronic equipment 10 and the HDD 12. In short, compared with other connectors 32 and 33, the male connector 34 is arranged at a position where the user can easily look at in connecting to the adapter 2.

The base member 35 is formed by folding a metal plate with a rectangular shape. As shown in FIG. 4, the base member 35 has a fixing portion 351 extending substantially in parallel with a rear side of the case body 41 and fixed to the lid member 42; a first folded surface 352 folded at a substantially right angle from the fixing portion 351 toward the side of the lid member 42; a connector attachment side 353 arranged in orthogonal to the first folded surface 352 and extending substantially in parallel with the fixing portion 351; and a second folded surface 354 folded at a substantially right angle from an edge of the connector attachment side 353 toward the out-of-plane direction thereof.

The fixing portion 351 has a rectangular shape in plan view and is provided with extending edges 351 A protruded toward the lid member 42 at both ends in the longitudinal direction. Holes are formed on the extending edges 351A for screws (not shown) to be inserted to fix the base member 35 to the lid member 42.

The connector attachment side 353 has a rectangular shape in plan view and is provided with the male power connector 32 and the IDE male connector 33 attached adjacent to each other in the longitudinal direction. A pair of circular holes 353A is provided at a position where the IDE male connector 33 is to be attached, corresponding to projecting portions (described later) of the IDE male connector 33.

Also, a pair of cutout portions 353B is formed on the connector attachment side 353, where the male power connector 32 is to be attached The cutout portion 353B is cut from an end of the shorter edge of the connector attachment side 353 (a ridge line connecting the connector attachment side 353 and the second folded surface 354) toward the inside of the connector attachment side 353, and an end of the cutout portion 353B reaches the fixing portion 351. The cutout direction of the cutout portion 353B in the connector attachment side 353 and the first folded surface 352 is along the shorter edges thereof. The other end of the cutout portion 353B reaches the second folded surface 354.

A width of the cutout portion 353B in a direction orthogonal to the cutout direction is substantially same at a part between the fixing portion 351 and the connector attachment side 353 (width L1). On the other hand, a width L2 of the part around the ridge line of the connector attachment side 353 and on the second folded surface 354 is greater than the width L1. Here, in the cutout portion 353B, the part formed on the second folded surface 354 and around the ridge line of the connector attachment side 353 is referred to as wide portions 353B1, while other parts are referred to as narrow portions 353B2.

Figure 5:
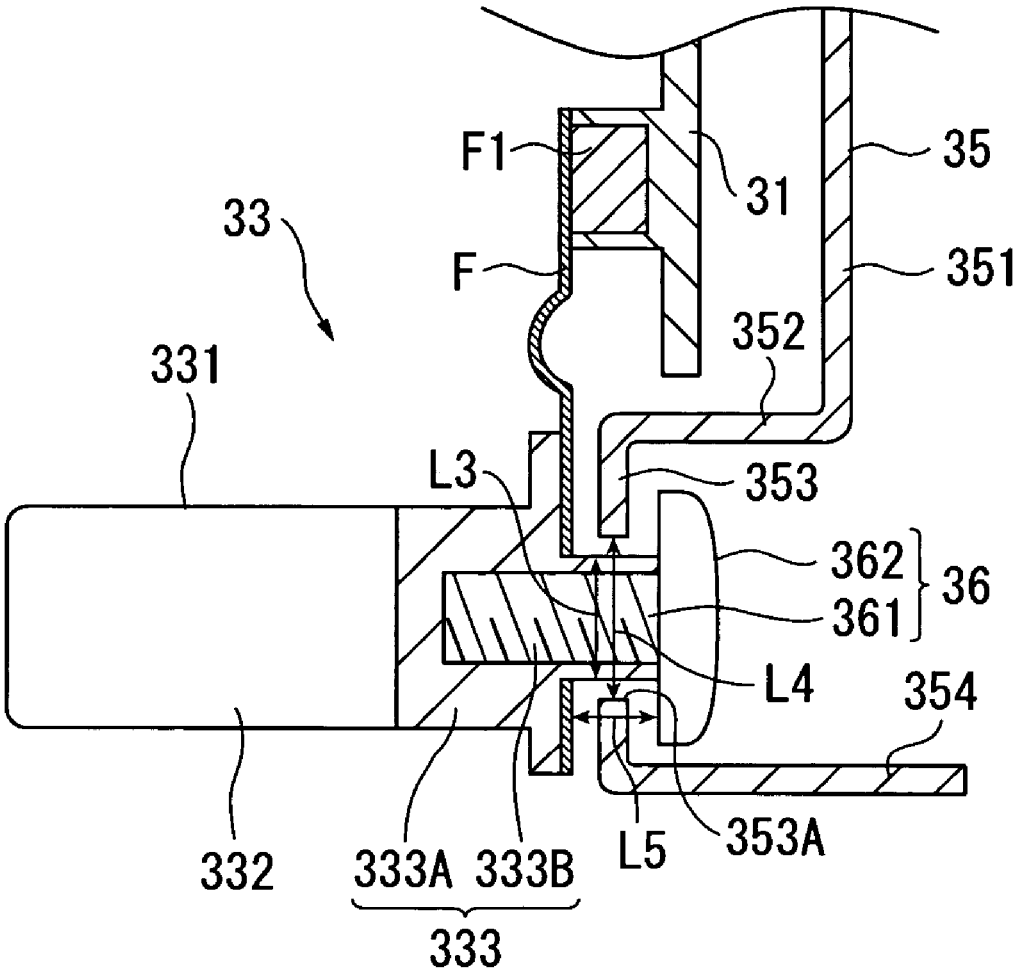
FIG. 5 is a cross section showing a primary portion of the connecting device.
Figure 6:
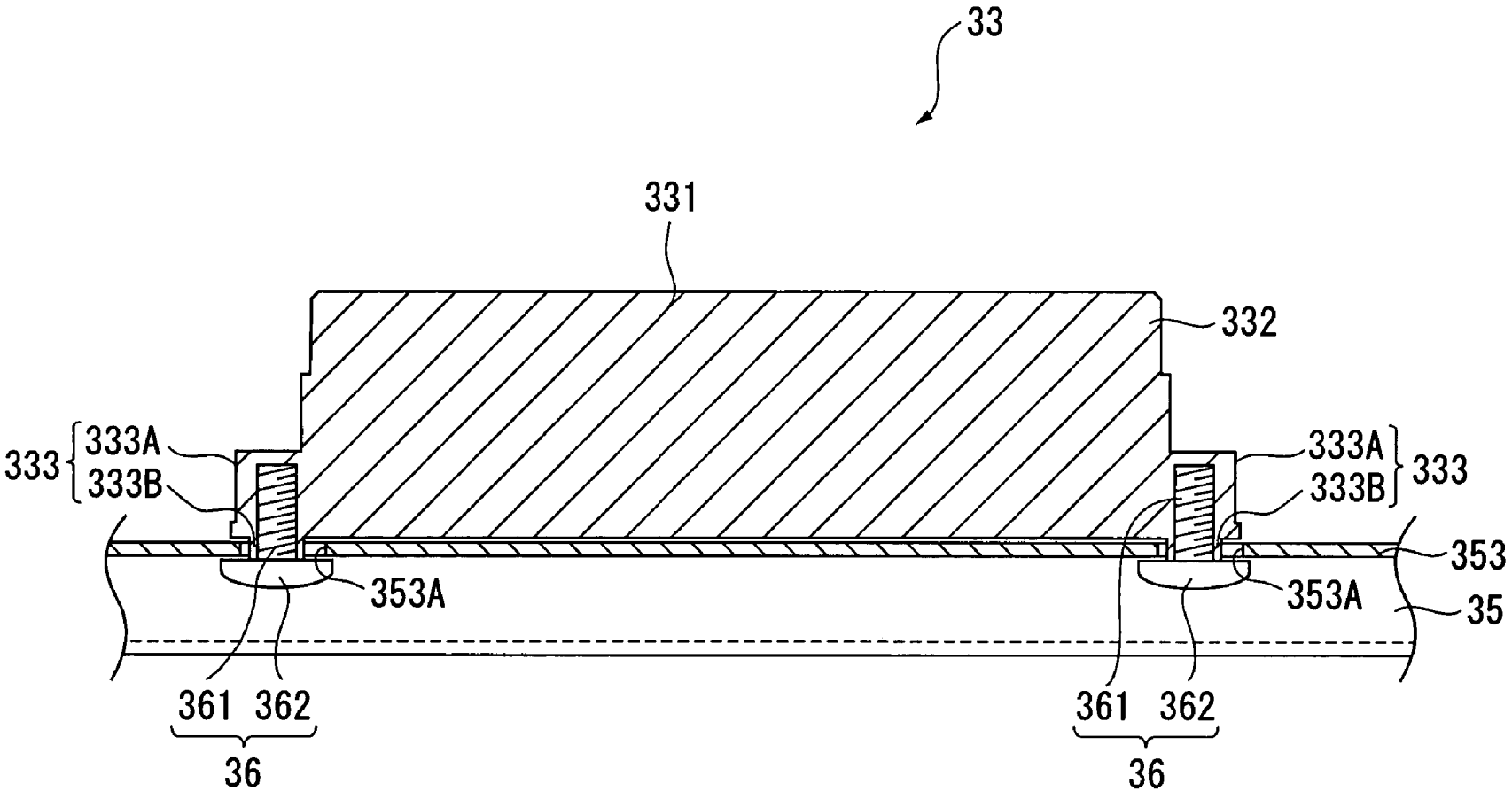
FIG. 6 is a cross section showing the connecting device cut along the longitudinal direction of a base member.

The IDE male connector 33 will be described with reference to FIGS. 5 and 6. FIG. 5 is a cross section of the IDE male connector 33 in a state of being attached to the base member 35 and cut along the shorter edge direction of the base member 35. FIG. 6 is a cross section of the IDE male connector 33 in a state of being attached to the base member 35 and cut along the longitudinal direction of the base member 35.

The IDE male connector 33 has a terminal (not shown) and a housing 331 storing the terminal therein. The housing 331 has a housing body 332 having a substantially rectangular shape in plan view and a socket 333 provided in the housing body 332.

The housing body 332 is so arranged that an end of the shorter edge (front end portion) can be inserted into the IDE female connector of the HDD 12, and the terminal is exposed from a surface of the front end portion. The other end of the shorter edge (rear end portion) constitutes an abutting surface to abut on the connector attachment side 353 of the base member 35.

The sockets 333 are provided to the housing body 332, respectively on both ends in the longitudinal direction The socket 333 has a socket body 333A abutting on the connector attachment side 353 of the base member 35 and a projecting portion (loose-fit portion) 333B projecting from the socket body 333A toward the connector attachment side 353 to be inserted into the hole 353A of the base member 35.

The engaging member 36 is attached to the socket body 333A and the projecting portion 333B so as to engage the connector 33 with the base member 35. In the present embodiment, a screw having a screw shaft 361 and a head 362 provided on a base end in the screwing direction thereof is used as the engaging member 36. Screw holes are provided on the socket body 333A and the projecting portion 333B for the screw shaft 361 to be screwed into.

A diameter L3 of the projecting portion 333B are smaller than a diameter L4 of the hole 353A of the base member 35. A length L5 of the projecting portion 333B along the insertion direction into the hole 353A is greater than a thickness of the connector attachment side 353 of the base member 35 so that the projecting portion 333B protrudes from the hole 353A of the connector attachment side 353. The projecting portion 333B holds the connector 33 in a loosely-fitted manner to the base member 35 when the engaging member 36 is attached to the socket 333.

In order to attach the above-described IDE male connector 33 to the base member 35, the projecting portion 333B of the IDE male connector 33 is inserted into the hole 353A of the base member 35 and then the engaging member 36 is inserted into the socket 333. Although not shown in FIGS. 4 and 6, a flexible substrate F is provided to a surface abutting on the connector attachment side 353 of the housing 331, as shown in FIG. 5. More specifically, the flexible substrate F is provided with a hole having a substantially identical diameter with the hole 353A of the base member 35 so that it can be attached to the housing 331 by inserting the projecting portion 333B into the hole. By providing a connecting portion F1 that can be connected to the substrate 31 and connecting it to the substrate 31, electric power can be supplied to the flexible substrate F from the substrate 31.

Figure 7:
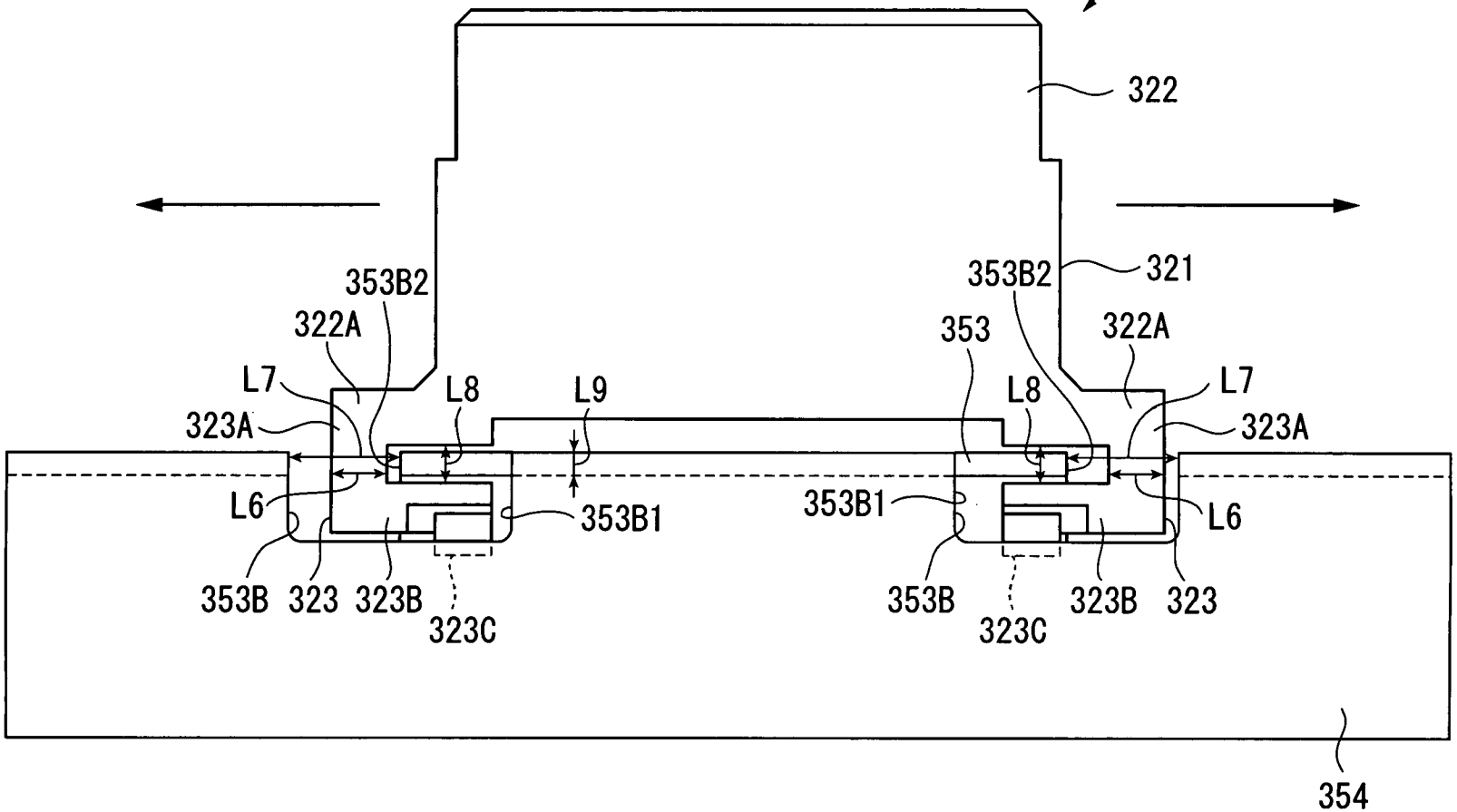
FIG. 7 is a plan view of the connecting device seen from the side of a second folded surface of the base member.
Figure 8:
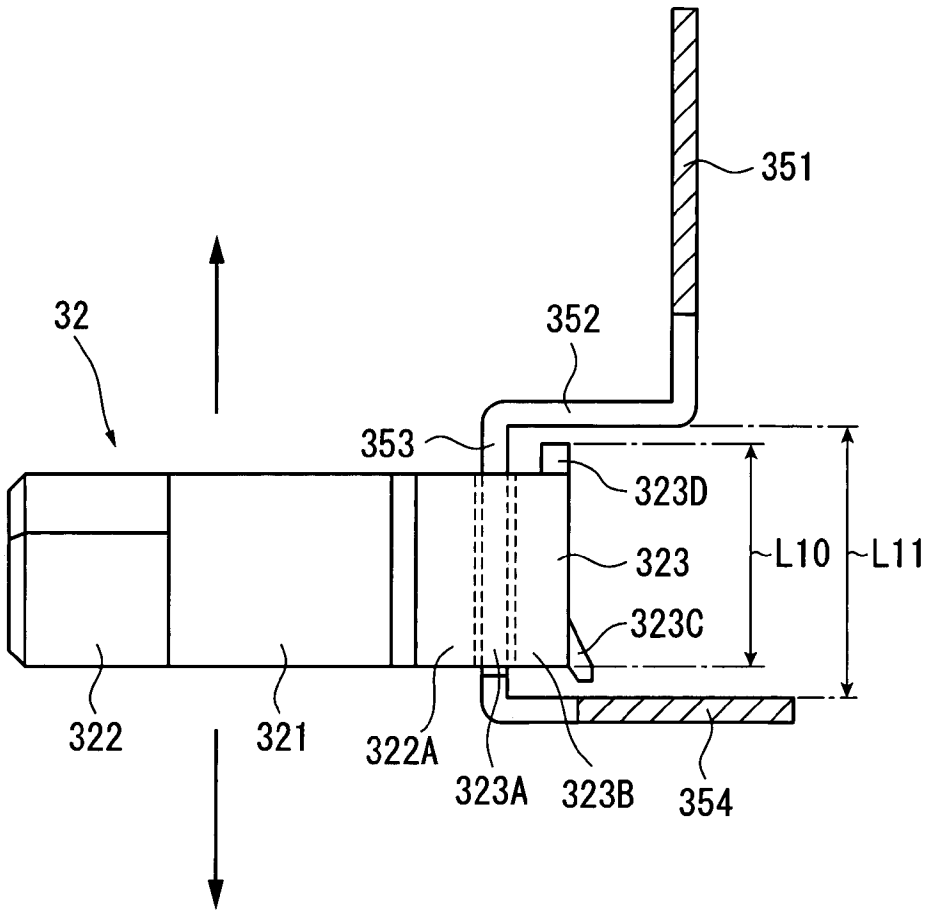
FIG. 8 is a cross section showing a primary portion of the connecting device.
Figure 9:
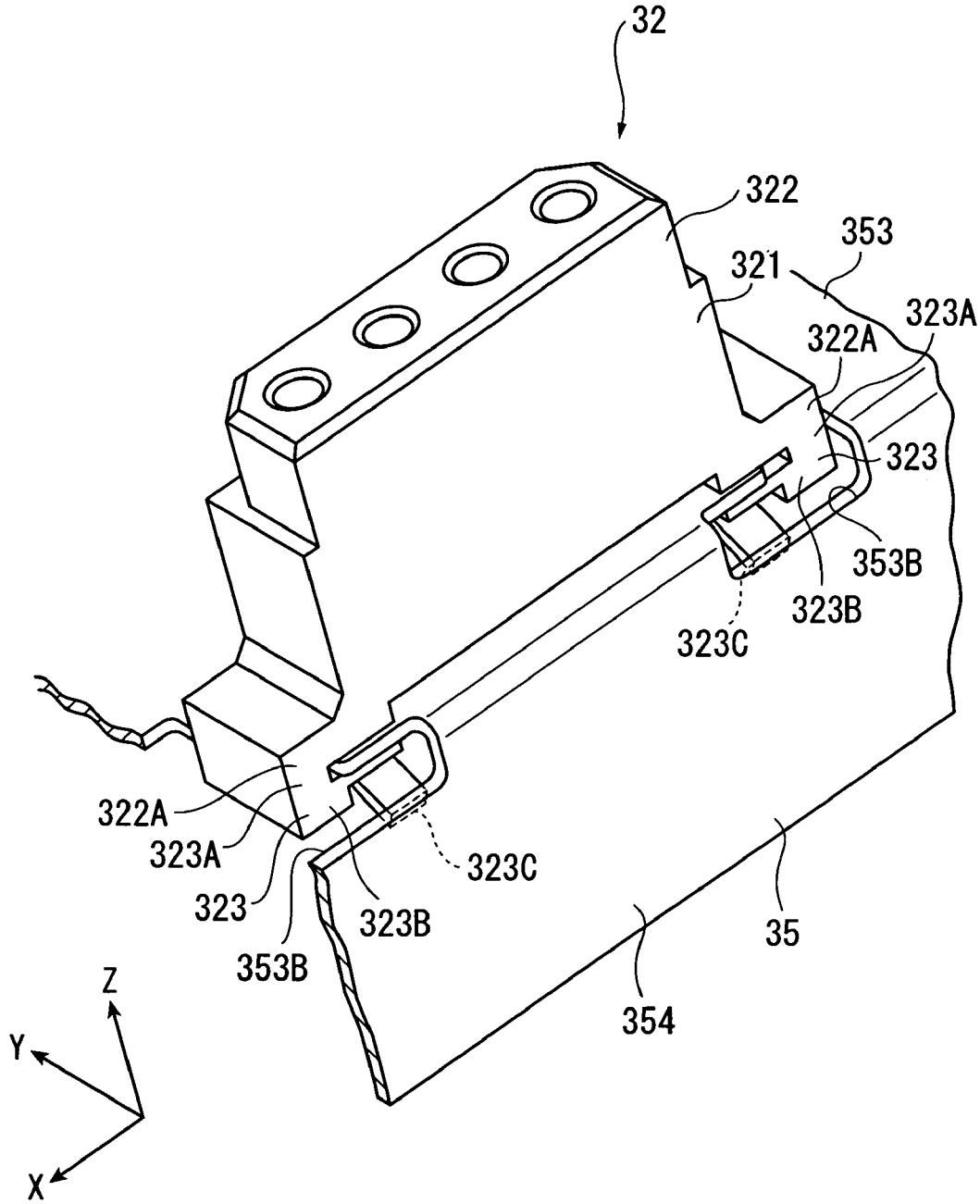
FIG. 9 is a perspective view of the connecting device seen from the side of the second folded surface of the base member.

Next, the male power connector 32 will be described with reference to FIGS. 4 and 7 to 9. FIG. 7 is a plan view showing the male power connector 32 attached to the base member 35 seen from the side of the second folded surface 354. FIG. 8 is a cross section of the male power connector 32 in a state of being attached to the base member 35 and cut along the shorter edge direction of the base member. FIG. 9 is a perspective view showing the male power connector 32 attached to the base member 35 seen from the side of the second folded surface 354.

The male power connector 32 has a terminal and a housing 321 storing the terminal therein.

The housing 321 has a housing body 322 having a substantially rectangular shape in plan view and insertion portions 323 provided in the housing body 322.

The housing body 322 is located on a front side of the connector attachment side 353 when the connector 32 is attached to the base member 35. The housing body 322 is so arranged that the terminal is exposed from an end (front end portion) in the shorter edge direction, and the front end portion can be inserted into the male power connector of the HDD 12.

On both ends in the longitudinal direction of the housing body 322 are formed with extending portions 322A protruding from the ends and extending substantially in parallel with the connector attachment side 353 of the base member 35.

The insertion portion 323 has a substantially L-shape in plan view and is integrally molded with the housing body 322. The insertion portion 323 is inserted from the side of the second folded surface 354 of the base member 35 into the cutout portion 353B when the connector 32 is attached to the base member 35. The insertion portion 323 has an insertion body 323A extending from a tip end of the extending portion 322A toward a direction orthogonal to the connector attachment side 353 to penetrate the cutout portion 353B and an engaging portion 323B provided on a tip end of the extending direction of the insertion body 323A.

As shown in FIG. 7, in the insertion body 323A, a width L6 in a direction orthogonal to the extending direction is smaller than a width L7 in a direction orthogonal to the cutout direction of the narrow portion 353B2 of the cutout portion 353B.

A length L8 of the extending direction of the insertion body 323A is greater than a thickness L9 of the connector attachment side 353. Further, as shown in FIG. 8, a height along the shorter edge direction of the connector attachment side 353 of the insertion body 323A is smaller than a length of the shorter edge direction of the connector attachment side 353.

The engaging portion 323B, as shown in FIG. 7, engages with a back side of the connector attachment side 353 of the base member 35 and faces the extending portion 322A with the connector attachment side 353 interposed therebetween. As described earlier, since the length L8 of an extending direction of the insertion body 323A connecting the engaging portion 323B and the extending portion 322A is set to be greater than the thickness L9 of the connector attachment side 353, a width of a space lying between the engaging portion 323B and the extending portion 322A facing the engaging portion 323B with the connector attachment side 353 interposed therebetween is greater than the thickness of the connector attachment side 353 of the base member 35.

As shown in FIG. 8, a projection 323D is formed on a tip end of the insertion direction of the engaging portion 323B into the cutout portion 353B. The projection 323D abuts on a back side of the first folded surface 352 when the insertion portion 323 is inserted into the cutout portion 353B.

In addition, as shown in FIGS. 8 and 9, an elastically-deformable detent 323C is provided on a back side of the engaging portion 323B. The detent 323C is integrally molded with the engaging portion 323B, extending from the back side of the engaging portion 323B toward the second folded surface 354. The detent 323C abuts on the second folded surface 354 to prevent the connector 32 from detaching from the base member 35 when the connector 32 is moved toward the second folded surface 354.

In this arrangement, a width L10 between a tip end of the detent 323C in the extending direction and a tip end of the projection 323D is set to be smaller than a width L11 between the first folded surface 352 and the second folded surface 354.

The insertion portion 323 is inserted from the side of the second folded surface 354 of the base member 35 into the cutout portion 353B when the IDE male connector 33 is attached to the base member 35. At this time, since the detent 323C of the engaging portion 323B is elastically deformable, it is inserted into the cutout portion 353B while being biased toward the engaging surface of the engaging portion 323B by a periphery of the cutout portion 353B formed on the second folded surface 354. When the insertion portion 323 is completely inserted into the cutout portion 353B, the bias at the periphery of the cutout portion 353B is removed. Thus, when the connector 32 is moved toward the second folded surface 354, the detent 323C abuts on the second folded surface 354 so that the connector 32 is securely attached to the base member 35.

According to the present embodiment, following advantages can be obtained.

(1) The diameter L3 of the projecting portion 333B of the socket 333 of the IDE male connector 33 inserted into the hole 353A of the base member 35 is smaller than the diameter L4 of the hole 353A, and the length L5 along the insertion direction of the projecting portion 333B into the hole 343A (Translator's comment: the hole 353A) is greater than the thickness of the connector attachment side 353 of the base member 35. Because of this arrangement, the IDE male connector 33 is supported in a loosely-fitted manner to the connector attachment side 353 of the base member 35 so that the attachment position of the IDE male connector 33 can be arbitrarily adjusted to the base member 35.

(2) Since the length L5 along the insertion direction of the projecting portion 333B into the hole 343A (Translator's comment: the hole 353A) is greater than the thickness of the connector attachment side of the base member 35, a clearance is formed between the housing body 332 of the connector 33 and the connector attachment side 353 to avoid close contact of them. Therefore, the attachment position of the connector 33 can be easily adjusted to the connector attachment side 353.

Figure 12:
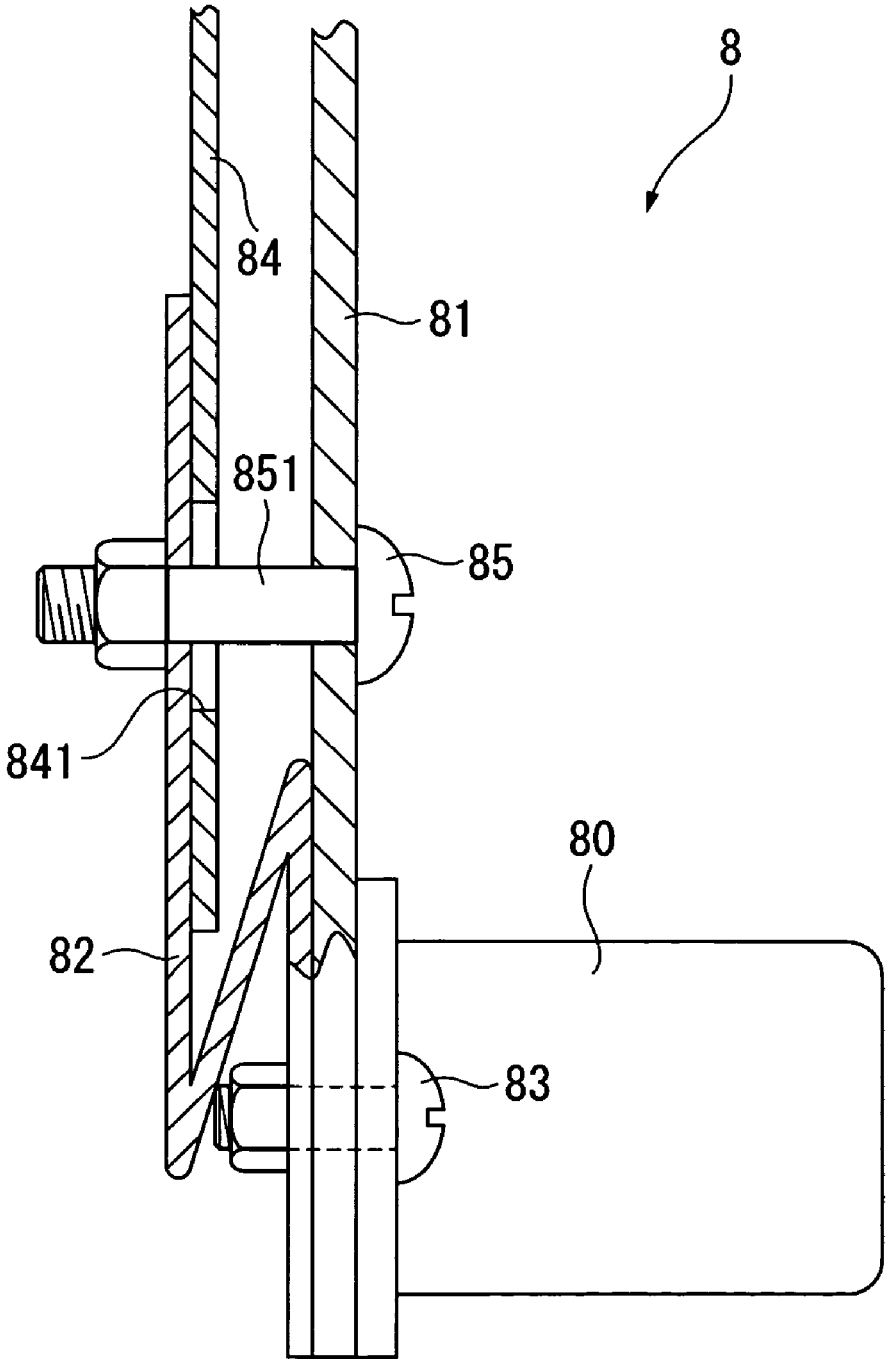
FIG. 12 is a cross section showing a conventional connecting device.

(3) The IDE male connector 33 and the male power connector 32 are attached directly to the base member 35. Thus, the number of components can be reduced and the structure can be simplified compared with the conventional connecting device shown in FIG. 12 in which a connector 80 is attached to a substrate 81 fixed to a movable plate 82, and the base member is disposed between the movable plate and the substrate to adjust the attachment position of the connector 80 by moving the movable plate 82 to a base member 84.

(4) The projecting portion 333B is provided to the socket 333 of the IDE male connector 33 so that the connector 33 can be attached to the base member 35 by inserting the projecting portion 333B into the hole 353A of the base member 35. Therefore, the attachment position of the connector 33 can be easily determined to the base member 35.

(5) Since the IDE connector is of the type having as many as 40 pins, a big force is applied to the IDE male connector 33 and the engaging member 36 when engagement of the male connector and the female connector is loosened. In the present embodiment, since the IDE male connector 33 and the engaging member 36 are engaged by screwing, it can prevent the engaging member 36 from being detached from the IDE male connector 33 even when such big force is applied.

(6) The width L10 between a tip end of the detent 323C of the male power connector 32 in the extending direction and a tip end of the projection 323D is smaller than the width L11 between the first folded surface 352 and the second folded surface 354, and the height of the insertion body 323A is smaller than the length of the shorter edge direction of the connector attachment side 353 (length of the cutout direction of a part of cutout portion 353B formed on the connector attachment side 353).

In addition, the width L6 orthogonal to the extending direction of the insertion body 323A of the insertion portion 323 is smaller than the width L7 orthogonal to the cutout direction of the narrow portion 353B2 of the cutout portion 353B. Therefore, in the cutout portion 353B, the insertion portion 323 of the connector 32 can be moved in the cutout direction and in the direction orthogonal to the cutout direction (X-axis direction and Y-axis direction in FIG. 9) in the part formed on the connector attachment side 353 so that the attachment position of the connector 32 can be adjusted to the connector attachment side 353.

(7) The length L8 of the extending direction of the insertion body 323A of the male power connector 32, which extends and penetrates the cutout portion 353B in the connector attachment side, is greater than the thickness L9 of the connector attachment side. Thus, the width of the space lying between the extending portion 322A provided on the base end of the insertion body 323A and the engaging portion 323B opposing the extending portion 322A with the connector attachment side 353 interposed therebetween is greater than the thickness of the connector attachment side 353. With this arrangement, clearances are formed between the engaging portion 323B of the connector 32 and the connector attachment side 353, and the extending portion 322A and the connector attachment side 353, so that the connector 32 can be moved in the direction of Z-axis in FIG. 9. Also, due to the clearances formed as described above, the friction is not likely to generate between the connector 32 and the connector attachment side 353 in moving the connector 32 in the directions of X-axis and Y-axis shown in FIG. 9, and therefore, the connector can be easily moved.

(8) Since the cutout portion 353B is provided with the wide portion 353B1 formed on the second folded surface and the insertion portion 323 of the connector 32 is inserted from this wide portion 353B1, the insertion portion 323 of the connector 32 can be easily inserted from the side of the second folded surface 354.

(9) Since the connector 32 has a detent 323C abutting on the second folded surface when the connector 32 is moved toward the second folded surface 354, the connector 32 is securely attached to the base member 35.

(10) Since the insertion portion 323 and the detent 323C are integrally molded with the housing body 322, the number of components can be reduced.

(11) Among the connectors 32 to 34 provided to the adapter 2, the attachment position of the male connector 34 is fixed. Accordingly, the adapter 2 can be attached to the HDD 12 and the electronic equipment 10 with the connector 34 as a positioning reference so that the connecting operation can be easily done only by checking the position of the connector 34.

(12) Further, the male connector 34 is attached above the other connectors 32 and 33. Therefore, in connecting the adapter 2 to the HDD12 and the electronic equipment 10, the position of the male connector 34 can be easily checked only by looking at the male connector 34 from above the adapter 2.

Incidentally, the scope of the present invention is not restricted to the above-described embodiments, but includes modifications and improvements as long as an object of the present invention can be achieved.

Figure 10:
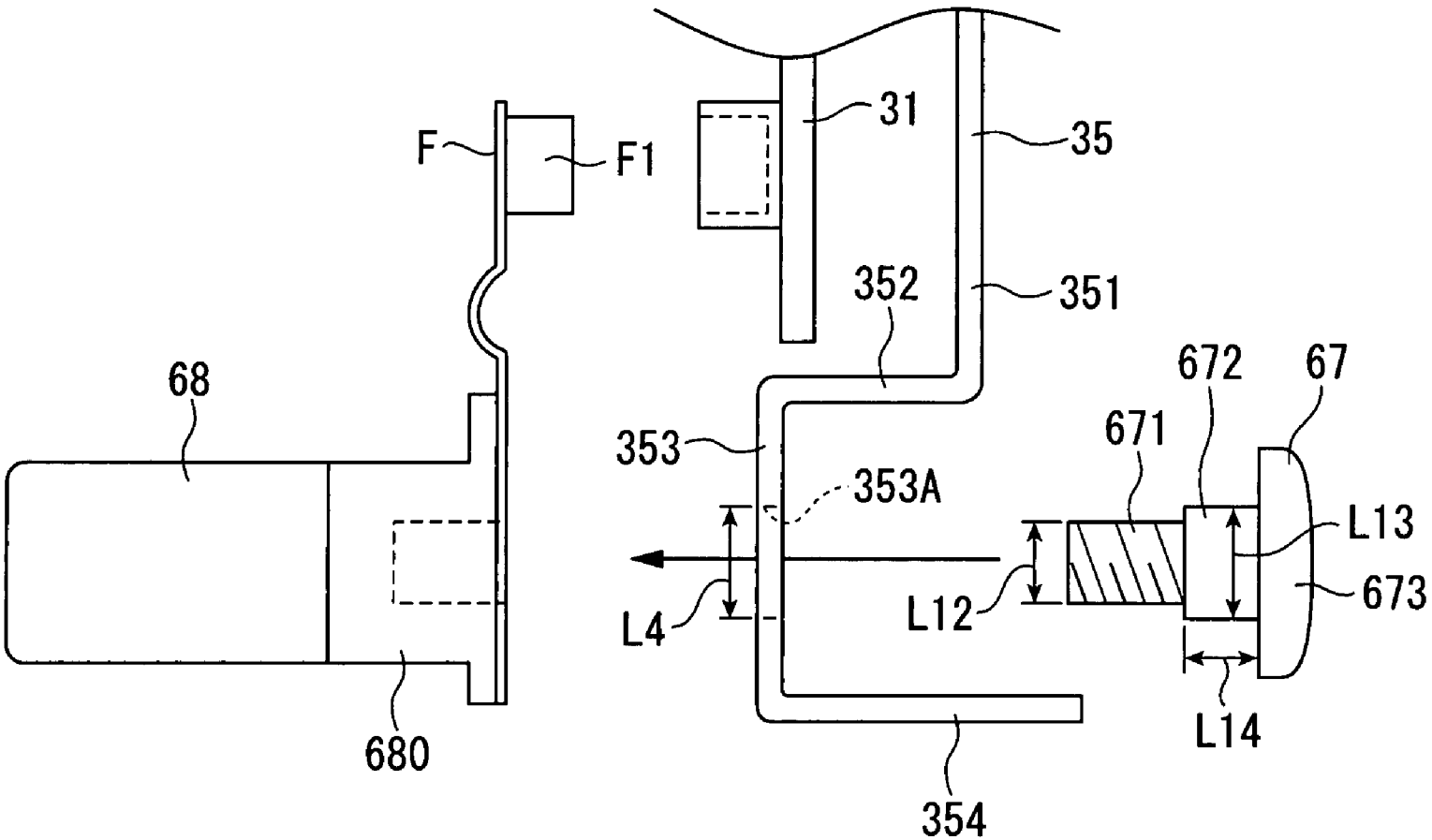
FIG. 10 is a plan view showing a modification of the connecting device.

For example, in the above-described embodiment, the socket 333 of the IDE male connector 33 has the projecting portion 333B, but the arrangement is not limited thereto, and the socket 680 may not be provided with a projecting portion as shown in FIG. 10. In this case, an engaging member 67 has a screw shaft 671 screwing into the socket 680, a loose-fit portion 672 provided on a base end of the screw shaft 671 in a screwing direction and having a greater diameter L13 than a diameter L12 of the screw shaft 671, and a head 673 provided on a base end of the loose-fit portion 672 in the screwing direction. The loose-fit portion 672 is also inserted into the hole 353A formed on the connector attachment side 353, and the loose-fit portion 672 may preferably have a diameter L13 smaller than the diameter L4 of the hole 353A and have a length L14 along the insertion direction into the hole 353A greater than the thickness of the connector attachment side 353.

In this arrangement, the loose-fit portion 672 may either be integrally molded with or separated from the screw shaft 671. If the loose fit portion 672 is separated from the screw shaft 671, the loose-fit portion 672 may have a ring-shape or the like and be provided on the base end of the screw shaft 671.

If a structure shown in FIG. 10 is selected, a socket 680, e.g. a screw hole for the engaging member 67 screwed into only requires to be added to the connector 68 having been conventionally used, so that the connector 68 does not have to be molded into a special shape. Therefore, the cost increase can be avoided.

Although the diameter of the loose-fit portion 672 is greater than that of the screw shaft 671 in FIG. 10, the diameters of the loose-fit portion and the screw shaft may the same.

Figure 11:
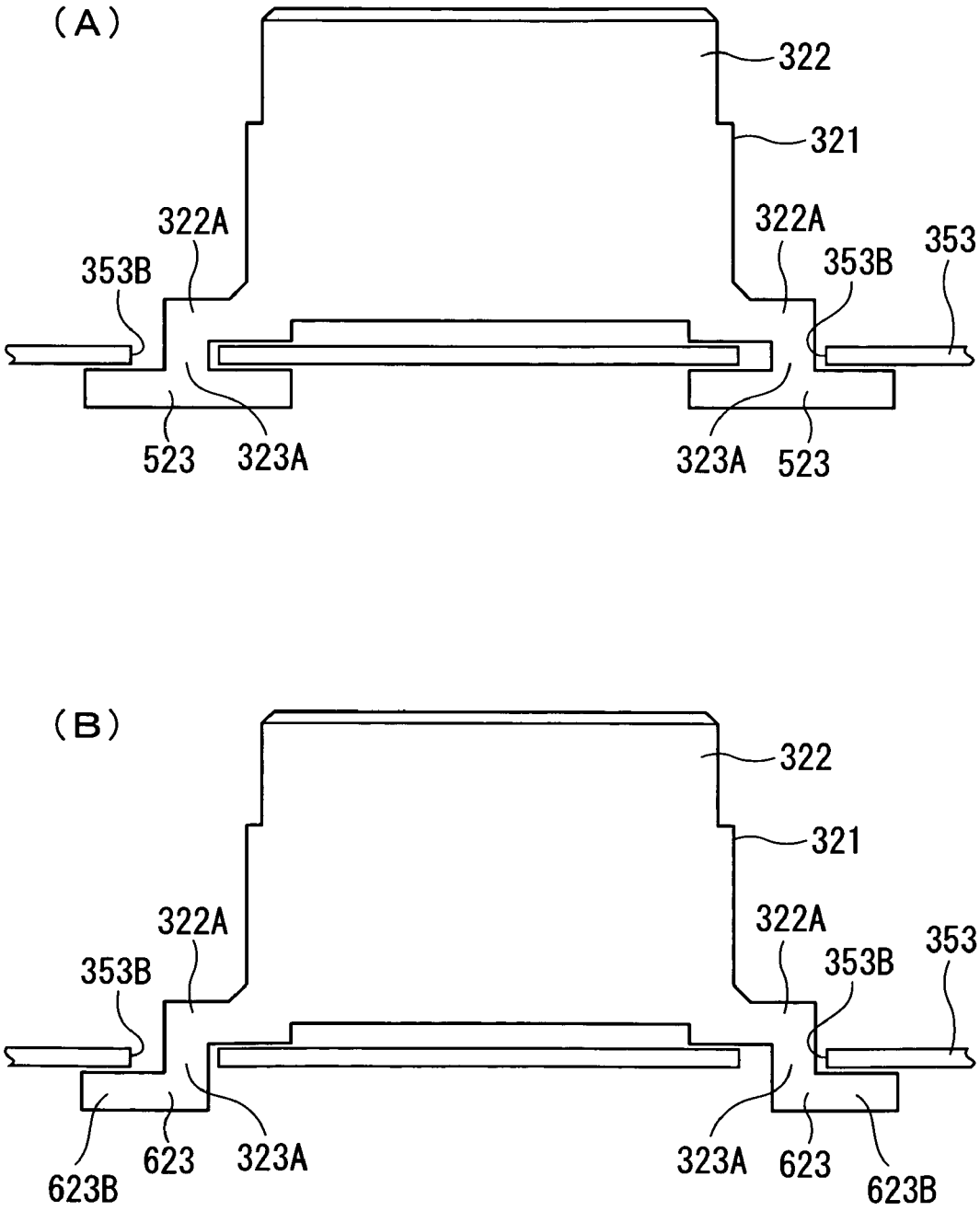
FIG. 11 is a schematic illustration showing another modification of the connecting device.

In the above-described embodiment, the insertion portion 323 of the male power connector 32 has a substantially L shape in plan view, but the shape is not limited thereto, and may be a substantially T shape in plan view like an insertion portion 523 shown in FIG. 11(A). As shown in FIG. 11(B), an engaging portion 623B of an insertion portion 623 may be arranged so as not to oppose the extending portion 322A. In any cases, the length of the extending direction of the insertion body 323A requires to be longer than the thickness of the connector attachment side 353.

Furthermore, in the above-described embodiment, the insertion portion 323 of the poser male connector 32 is integrally molded with the housing body 322, but, the configuration is not limited thereto, and the insertion portion may be separated.

In the above-described embodiment, the male power connector 32 has the detent 323C, but a configuration without the detent 323C may be selected. In this case, since the detent 323C does not have to be formed, the manufacturing of the male power connector 32 can be simplified.

In the above-described embodiment, the adapter 2 has the male connectors 32 to 34, but the configuration is not limited thereto, and may have female connectors.

In the above-described embodiment, the connectors provided to the adapter 2 are the power connector 32, the IDE connector 33, and the connector 34, but types of the connectors are not limited there to, and a USB connector, a SCSI (Small Computer System Interface) connector, and the like may be selected.

Further, in the above-described embodiment, two connectors 32 and 33 are attached to the base member 35, but the number of connectors attached to the base member 35 may either be one or more than two.

Still further, in the above-described embodiment, among connectors 32 to 34 of the adapter 2, the adjustment position of the male connector 34 is fixed and the other connectors 32 and 33 are adjustable, but the configuration is not limited thereto, and the attachment position of the connector may be adjustable. The attachment positions of the male power connector and the IDE male connector may be fixed.

In the above-described embodiment, the adapter 2 has the connector unit (adapter body 3), but the configuration is not limited thereto, and the connector unit of the present invention may be mounted on, for example, the HDD 12 as the second electronic equipment. In this case, the HDD 12 is to have a base member, an IDE female connector attached to the base member in loosely-fitted manner, and a connector unit having a power female connector.

Further, in the above-describe embodiment, the first electronic equipment 10 is electronic equipment as a body of an entertainment device, but it is not limited thereto, and the first electronic equipment may be a personal computer and the second electronic equipment may be a mobile phone, and they may be connected through the connecting device to perform data transfer, or the like.

INDUSTRIAL APPLICABILITY

The connecting device according to the present invention is useful for the connecting device mutually connecting the electronic equipment and another electronic equipment through a plurality of connectors. The connector and the connector unit of the present invention are suitable for being utilized in such connecting device. In addition, the electronic equipment of the present invention has the above-described connector unit.

The invention claimed is:

1. A connecting device connecting an electronic equipment and another electronic equipment connected thereto through a plurality of connectors, the connecting device comprising:

a base member to which at least any one of the connectors is attached, wherein the base member has a connector attachment side to which the connector is attached, the attachment side being provided with a cutout portion being cut from an end of the connector attachment side toward the inside thereof, wherein the connector attached to the base member has a housing body located on a front side of the connector attachment side of the base member, and an insertion portion provided to the housing body and inserted into the cutout portion from the end of the connector attachment side, wherein the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member, wherein a width of the insertion body orthogonal to the extending direction is smaller than a width of the cutout portion orthogonal to the cutout direction, and a length of the insertion body in the extending direction is greater than a thickness of the connector attachment side of the base members, wherein the base member comprises a folded surface folded from the connector attachment side toward the out-of-plane direction thereof, wherein the cutout portion is so arranged that a first end is cut from a ridge line of the connector attachment side and the folded surface toward the inside thereof and a second end reaches the folded surface, the cutout portion having a greater width in the part formed on the folded surface in orthogonal to the cutout direction than a width of the first end cut toward the inside of the connector attachment side, wherein the insertion portion is inserted from the folded surface side of the cutout portion, and wherein the connector has a detent abutting on the folded surface and preventing the attached connector from detaching from the base member.

2. The connecting device according to claim 1, wherein the insertion portion and the detent are integrally molded with the housing body.

3. The connecting device according to claim 1, wherein the plurality of connectors are disposed on a common side of the base member.

4. The connecting device according to claim 1, wherein an attachment position of at least one of the plurality of connectors is fixed.

5. A connector unit comprising a connector and a base member for the connector to be attached, wherein the base member has a connector attachment side for the connector to be attached, the connector attachment side being provided with a cutout portion cut from an end toward the inside thereof, wherein the connector has a housing body located on a front side of the connector attachment side when it is attached to the connector, and an insertion portion provided to the housing body and inserted into the cutout portion from the end of the connector attachment side, wherein the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member, wherein a width of the insertion body orthogonal to the extending direction is smaller than a width of the cutout portion orthogonal to the cutout direction, and wherein a length of the extending direction of the insertion body is greater than a thickness of the connector attachment side of the base member, wherein the base member comprises a folded surface folded from the connector attachment side toward the out-of-plane direction thereof, wherein the cutout portion is so arranged that a first end is cut from a ridge line of the connector attachment side and the folded surface toward the inside thereof and a second end reaches the folded surface, the cutout portion having a greater width in the part formed on the folded surface in orthogonal to the cutout direction than a width of the first end cut toward the inside of the connector attachment side, wherein the insertion portion is inserted from the folded surface side of the cutout portion, and wherein the connector has a detent abutting on the folded surface and preventing the attached connector from detaching from the base member.

6. A connector attached to a base member, wherein the base member has a connector attachment side for a connector to be attached, the connector attachment side provided with a cutout portion cut from an end toward the inside thereof;

wherein the connector has a housing body located on a front side of the connector attachment side of the base member, and an insertion portion provided to the housing body and inserted into the cutout portion from the end of the connector attachment side, wherein the insertion portion has an insertion body extending from the housing body in a direction orthogonal to the connector attachment side to penetrate the cutout portion and, an engaging portion disposed at a tip end of the extending direction of the insertion body to engage at the back side of the connector attachment side of the base member, and wherein a width of the insertion body orthogonal to the extending direction is smaller than a width of the cutout portion orthogonal to the cutout direction, and a length of the insertion body in the extending direction is greater than a thickness of the connector attachment side, wherein the base member comprises a folded surface folded from the connector attachment side toward the out-of-plane direction thereof, wherein the cutout portion is so arranged that a first end is cut from a ridge line of the connector attachment side and the folded surface toward the inside thereof and a second end reaches the folded surface, the cutout portion having a greater width in the part formed on the folded surface in orthogonal to the cutout direction than a width of the first end cut toward the inside of the connector attachment side, wherein the insertion portion is inserted from the folded surface side of the cutout portion, and wherein the connector has a detent abutting on the folded surface and preventing the attached connector from detaching from the base member.

7. An electronic equipment comprising a connector and a connector unit having a base member for the connector to be attached, wherein the base member of the connector unit has a connector attachment side to which the connector is attached, the connector attachment side being provided with a cutout portion being cut from an end toward the inside thereof, wherein the connector has a housing body located on a front side of the connector attachment side when it is attached to the connector, and an insertion portion provided to the housing body and inserted into the cutout portion from the end of the connector attachment side, wherein the insertion portion has an insertion body extending from the housing body in a direction orthogonal to the connector attachment side to penetrate the cutout portion, and an engaging portion disposed at a tip end of the extending direction of the insertion body to engage at the back side of the connector attachment side of the base member, wherein a width of the insertion body orthogonal to the extending direction is smaller than a width of the cutout portion orthogonal to the cutout direction, and wherein a length of the extending direction of the insertion body is greater than a thickness of the connector attachment side of the base member, wherein the base member comprises a folded surface folded from the connector attachment side toward the out-of-plane direction thereof, wherein the cutout portion is so arranged that a first end is cut from a ridge line of the connector attachment side and the folded surface toward the inside thereof and a second end reaches the folded surface, the cutout portion having a greater width in the part formed on the folded surface in orthogonal to the cutout direction than a width of the first end cut toward the inside of the connector attachment side, wherein the insertion portion is inserted from the folded surface side of the cutout portion, and wherein the connector has a detent abutting on the folded surface and preventing the attached connector from detaching from the base member.

* * * * *